US006622462B2

(12) United States Patent
Wakabayashi et al.

(10) Patent No.: US 6,622,462 B2
(45) **Date of Patent: *Sep. 23, 2003**

(54) DEVICE FOR REPLACING AIR WITHIN A CONTAINER HEADSPACE

(75) Inventors: Norimitsu Wakabayashi, Kawasaki (JP); Youichi Hayatsu, Tokyo (JP)

(73) Assignee: Showa Tansan Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/490,853

(22) Filed: Jan. 24, 2000

(65) Prior Publication Data

US 2003/0014949 A1 Jan. 23, 2003

(51) Int. Cl.[7] ..... B65B 31/02

(52) U.S. Cl. ..... 53/510; 53/432; 426/397

(58) Field of Search ..... 53/432, 510; 426/397, 426/407, 399, 401, 432–434, 594, 546, 541, 544

(56) References Cited

U.S. PATENT DOCUMENTS

| | | | | | |
|---|---|---|---|---|---|
| 4,506,600 | A | * | 3/1985 | Hersom et al. | 53/510 |
| 4,602,473 | A | * | 7/1986 | Hayashi et al. | 53/510 |
| 4,793,712 | A | * | 12/1988 | Kostecki | 366/349 |
| 4,831,811 | A | * | 5/1989 | Nixon et al. | 426/316 |
| 4,885,897 | A | * | 12/1989 | Gryouda et al. | 53/407 |
| 5,384,143 | A | * | 1/1995 | Koyama et al. | 426/546 |
| 5,617,705 | A | * | 4/1997 | Sanfilippo et al. | 53/432 |
| 5,722,449 | A | * | 3/1998 | Heinonen et al. | 137/101.19 |
| 5,853,782 | A | * | 12/1998 | Larsson | 426/474 |
| 5,885,640 | A | * | 3/1999 | Andersson | 426/106 |
| 6,231,907 | B1 | * | 5/2001 | Kini et al. | 53/432 |

* cited by examiner

*Primary Examiner*—Rinaldi I. Rada
*Assistant Examiner*—Hemant M. Desai
(74) *Attorney, Agent, or Firm*—Jordan and Hamburg LLP

(57) ABSTRACT

The air remaining within a headspace of a can filled with a liquid such as a carbonated drink, juice drink, tea drink, coffee drink or the like is replaced with one of steam, a mixture of steam and carbonic acid gas, a mixture of steam and nitrogen gas, and a mixture of carbonic acid gas and nitrogen gas. Therefore, the quality of filled liquid can be maintained, and deterioration of the working environment can be prevented by avoiding the spraying of carbonic acid in all directions at the workshop.

8 Claims, 14 Drawing Sheets

DEVICE FOR REPLACING AIR WITHIN A CONTAINER HEADSPACE

BACKGROUND OF THE INVENTION

This invention relates to an apparatus for replacing air within a headspace of a container when filling liquid therein, and more particularly to such an apparatus for replacing air within a headspace of a container filled with a liquid such as a carbonated drink, juice drink, tea drink, coffee drink or the like.

A conventional container filled with a liquid by a filling machine is transferred to a sealing machine that seals by means of a cap or the like, and during a period when the air in the container is replaced.

Concerning such conventional air replacing apparatus, carbonic acid gas is blown into the headspace of the can which is filled with a liquid. Therefore, the air replacing apparatus in the prior art can maintain the quality of a liquid such as carbonated drink, juice drink or the like, however, the working environment becomes worse due to the carbonic acid gas blowing in all directions at the workshop.

SUMMARY OF THE INVENTION

In view of the foregoing, it is an object of the present invention to provide an apparatus for replacing air within a headspace of a container which can maintain the quality of a liquid such as carbonated drink, juice drink or the like filled into a can. It is another object of the present invention to provide an apparatus for replacing air within a headspace of a container by being blown with either of steam, a mixture of steam and carbonic acid gas and a mixture of steam and nitrogen gas. It is still another object of the present invention to provide such an apparatus for replacing air within a headspace of a container which can prevent the worsening of the working environment due to the spraying of carbonic acid gas in all directions inside the working place.

The above and further objects and novel features of the invention will more fully appear from the following detailed description when the same is read in connection with the accompanying drawings.

It is to be expressly understood, however, that the drawings are for the purpose of illustration only and are not intended as a definition of the limits of the invention.

DETAILED DESCRIPTION OF THE INVENTION

Figure 1:
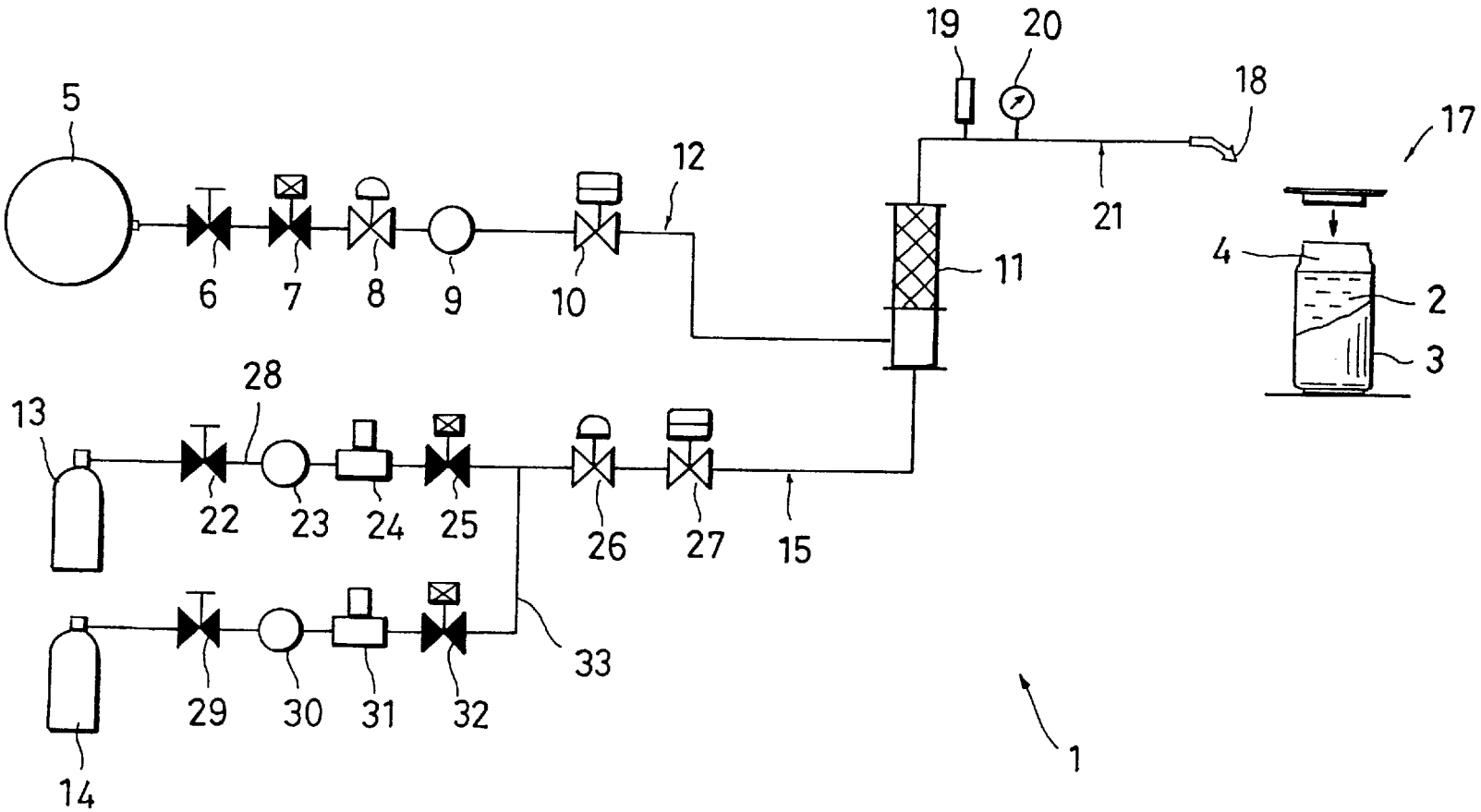
FIG. 1 is an explanatory view showing a first embodiment of the present invention.
Figure 2:
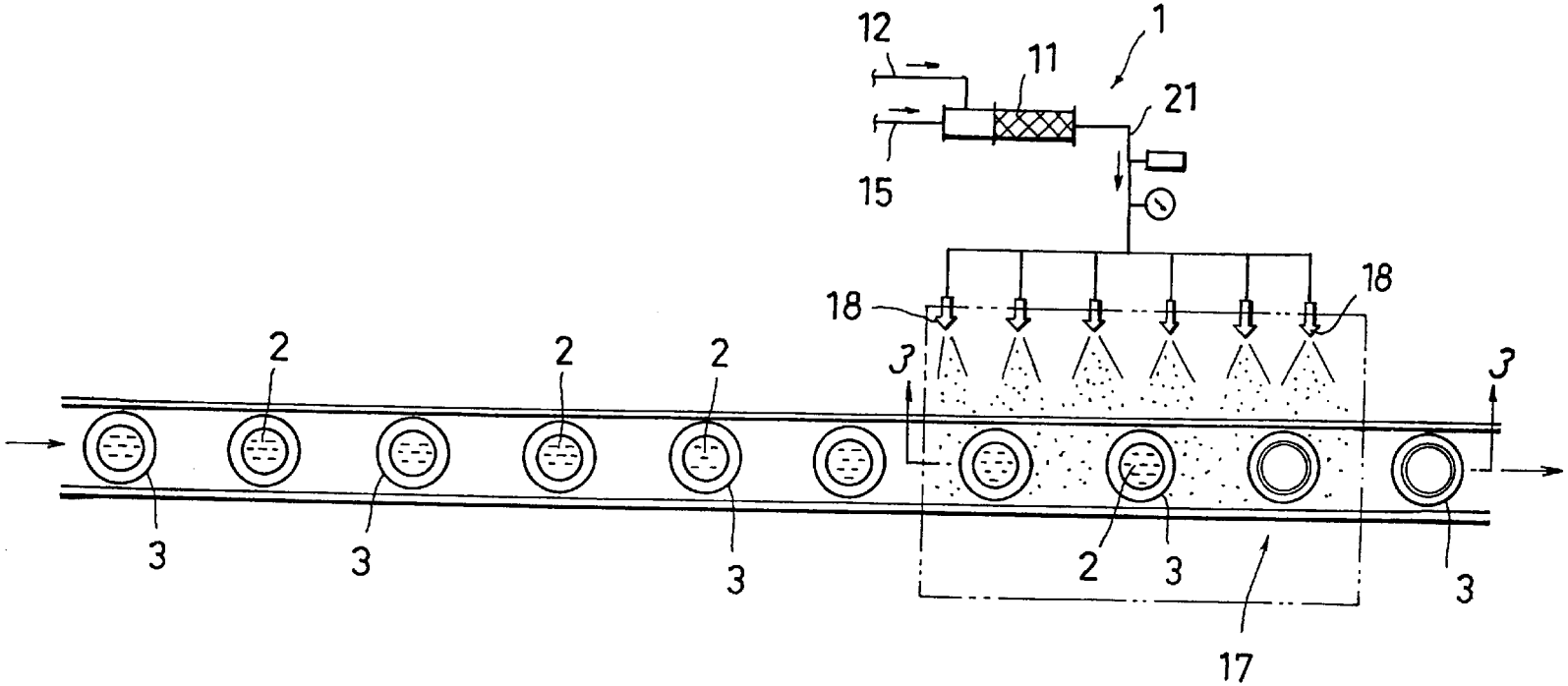
FIG. 2 is a top view illustrating a state in which a mixture of steam and gas is blown showing the first embodiment of the present invention.
Figure 3:
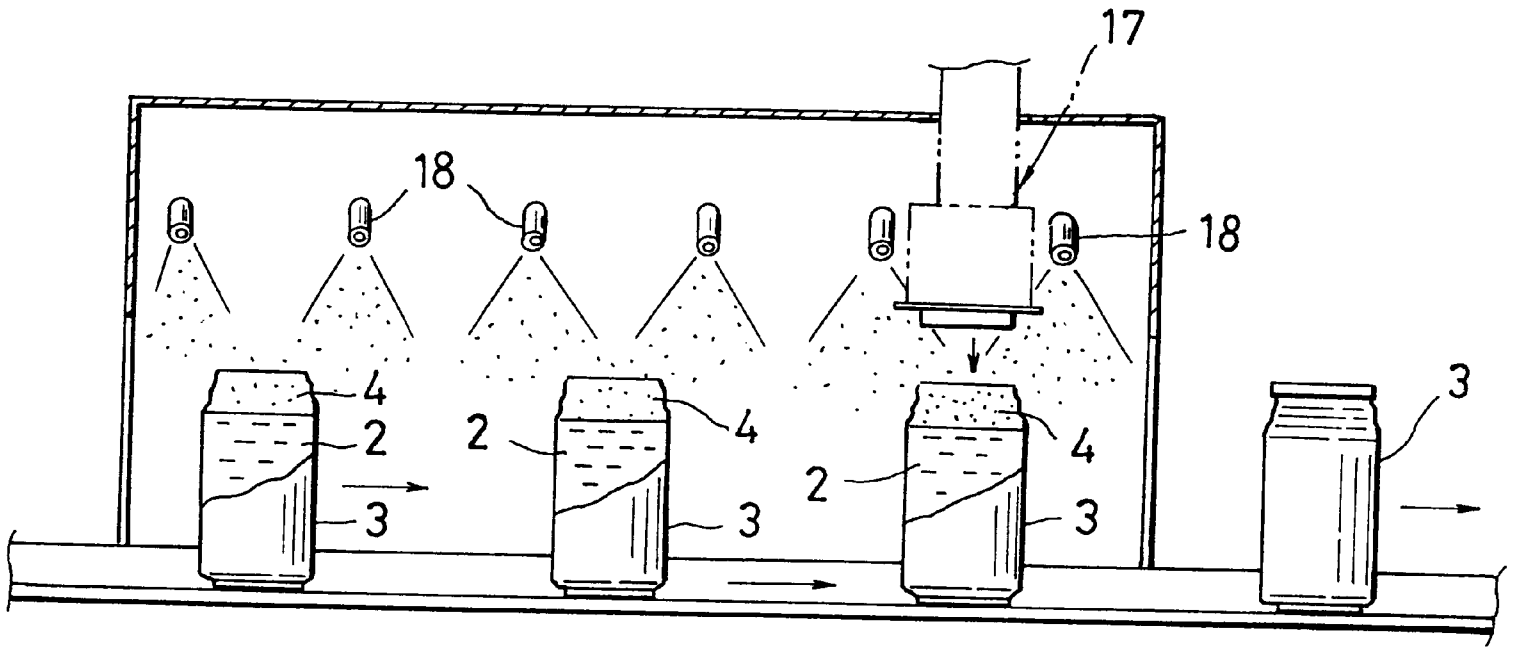
FIG. 3 is a sectional view taken along line of 3—3 in FIG. 2.

Preferred embodiments of the present invention are described in more detail below with reference to the accompanying drawings.

An understanding of the present invention may be best gained by reference FIGS. 1 to 6. FIGS. 1 to 6 illustrate an apparatus for replacing air within a headspace of a container of the first embodiment of the present invention.

Numeral 1 shows an apparatus for replacing air within a headspace 4 of a container defining a can 3 filled with a carbonated drink 2 by being blown with gases including a mixture of steam and carbonic acid gas or a mixture of steam and nitrogen gas into the headspace 4 of the can 3 to replace the air therein.

The apparatus 1 is composed of a boiler 5 generating steam, a supply path 12 of steam, a supply path 15 of gas and a supply path 21 of a mixture of gases. The steam supply path 12 includes a closure valve 6, an electromagnetic valve 7, a reducing valve 8, a filter 9 and a control valve for steam flow 10. The steam generated by the boiler 5 is admitted through the steam supply path 12 to a mixer 11. The gas supply path 15 allows gas to flow from either of a carbonic acid gas reservoir 13 defining a gas cylinder, tank or the like and a nitrogen gas reservoir 14 defining, the gas cylinder, tank or the like to the mixer 11. The mixed gas supply path 21 includes a thermometer 19 and a pressure gauge 20. A mixed gas mixed into the mixer 11 is admitted through a thermometer 19 and the pressure gauge 20 to a nozzle 18. The mixed gas 16 is blown into the headspace 4 of the can 3 filled with a liquid defining a carbonated drink 2 by the nozzle 18.

The gas supply path 15 further includes a supply path 28 of carbonic acid gas and a supply path 33 of nitrogen gas. The supply path 28 introduces carbonic acid gas and includes a closure valve 22, a filter 23, a mass-flowmeter 24, an electromagnetic valve 25, a reducing valve 26 and a control valve 27 for gas-flow. The carbonic acid gas provided from the carbonic acid gas reservoir 13 is admitted through the carbonic acid gas supply path 28 to the mixer 11.

The supply path 33 introduces nitrogen gas includes a closure valve 29, a filter 30, a mass-flowmeter 31 and an electromagnetic valve 32. A bottom end of supply path 33 is connected to a portion located between the electromagnetic valve 25 and the reducing valve 26 of the supply path 28. The nitrogen gas provided from the nitrogen gas reservoir 14 is admitted through the supply path 33 to the supply path 28.

Figure 4:
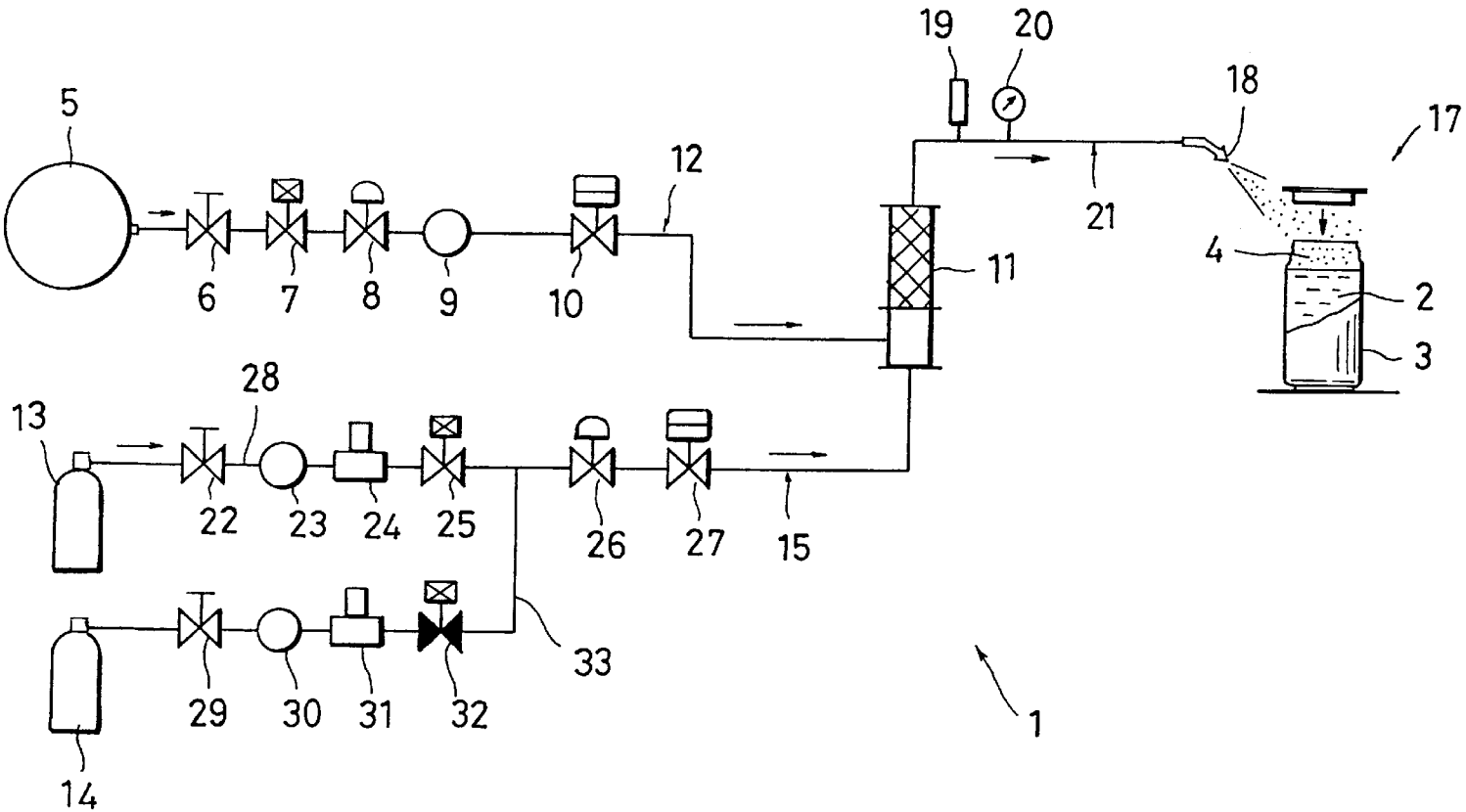
FIG. 4 is an explanatory view of supplying a mixture of steam and carbonic acid gas showing the first embodiment of the present invention.

In accordance with the above-mentioned invention, at first, when the mixture of steam and carbonic acid gas is blown into the headspace 4 of the can 3 filled with the carbonated drink 2, as shown in FIG. 4, the steam is supplied into the mixer 11 by opening the closure valve 6 and electromagnetic valve 7 of the steam supply path 12. Likewise, the carbonic acid gas is supplied into the mixer 11 by opening the closure valve 22 and electromagnetic valve 25 of the carbonic acid gas supply path 28 of the gas supply path 15. A mixture of steam and carbonic acid gas defining an inert gas is blown out of the nozzle 18, and the mixture gas has been blown into the headspace 4 of the can 3.

Figure 5:
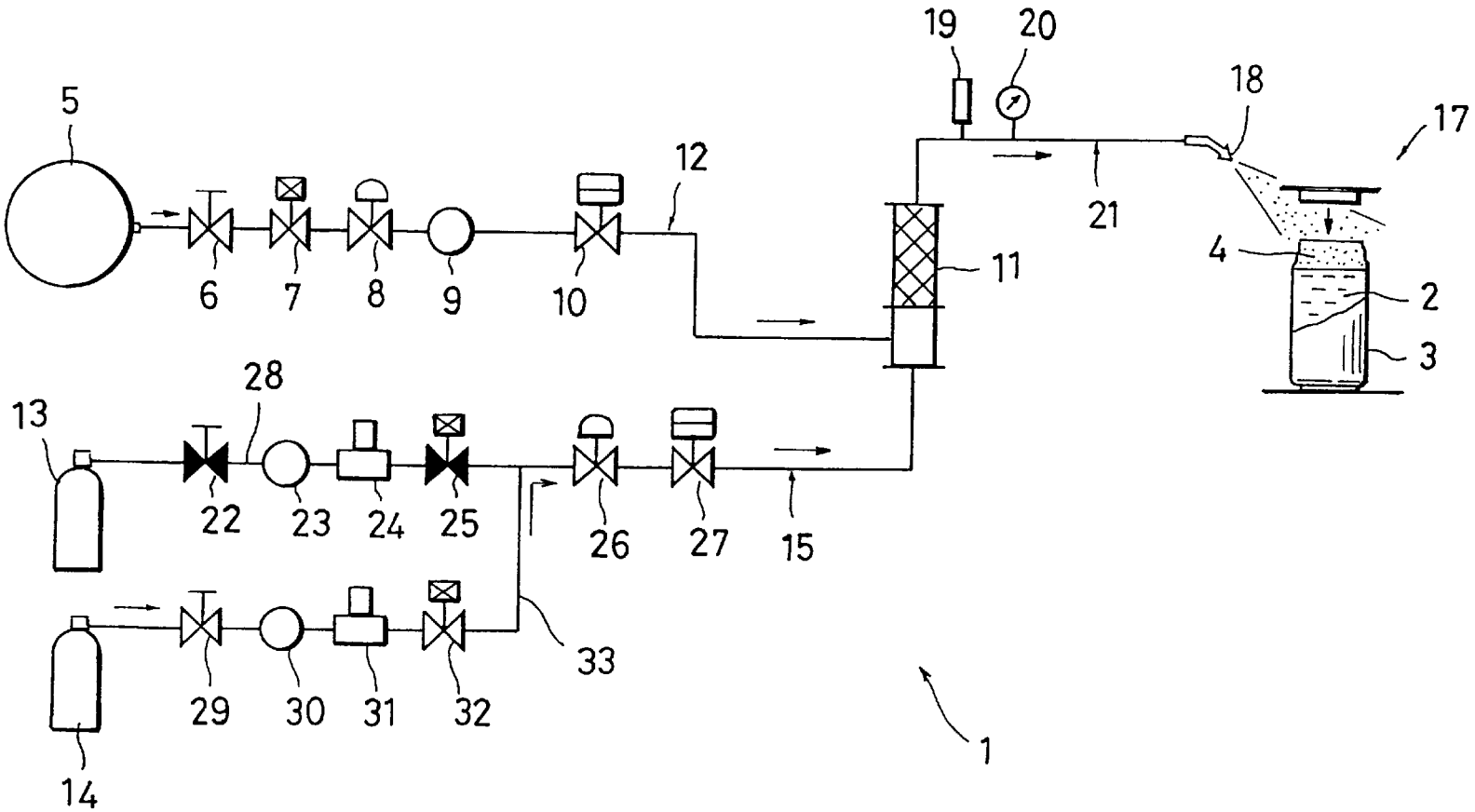
FIG. 5 is an explanatory view of supplying a mixture of steam and nitrogen gas showing the first embodiment of the present invention.

When the mixture of steam and nitrogen gas is blown into the headspace 4 of the can 3, as shown in FIG. 5, the steam is supplied into the mixer 11 by opening the closure valve 6 and electromagnetic valve 7 of the steam supply path 12. Likewise, the nitrogen gas is supplied into the mixer 11 by opening the closure valve 29 and electromagnetic valve 32 of the gas supply path 15. A mixture of steam and nitrogen gas defining an inert gas is blown out of the nozzle 18, and the mixed gas has been blown into the headspace 4 of the can 3.

Figure 6:
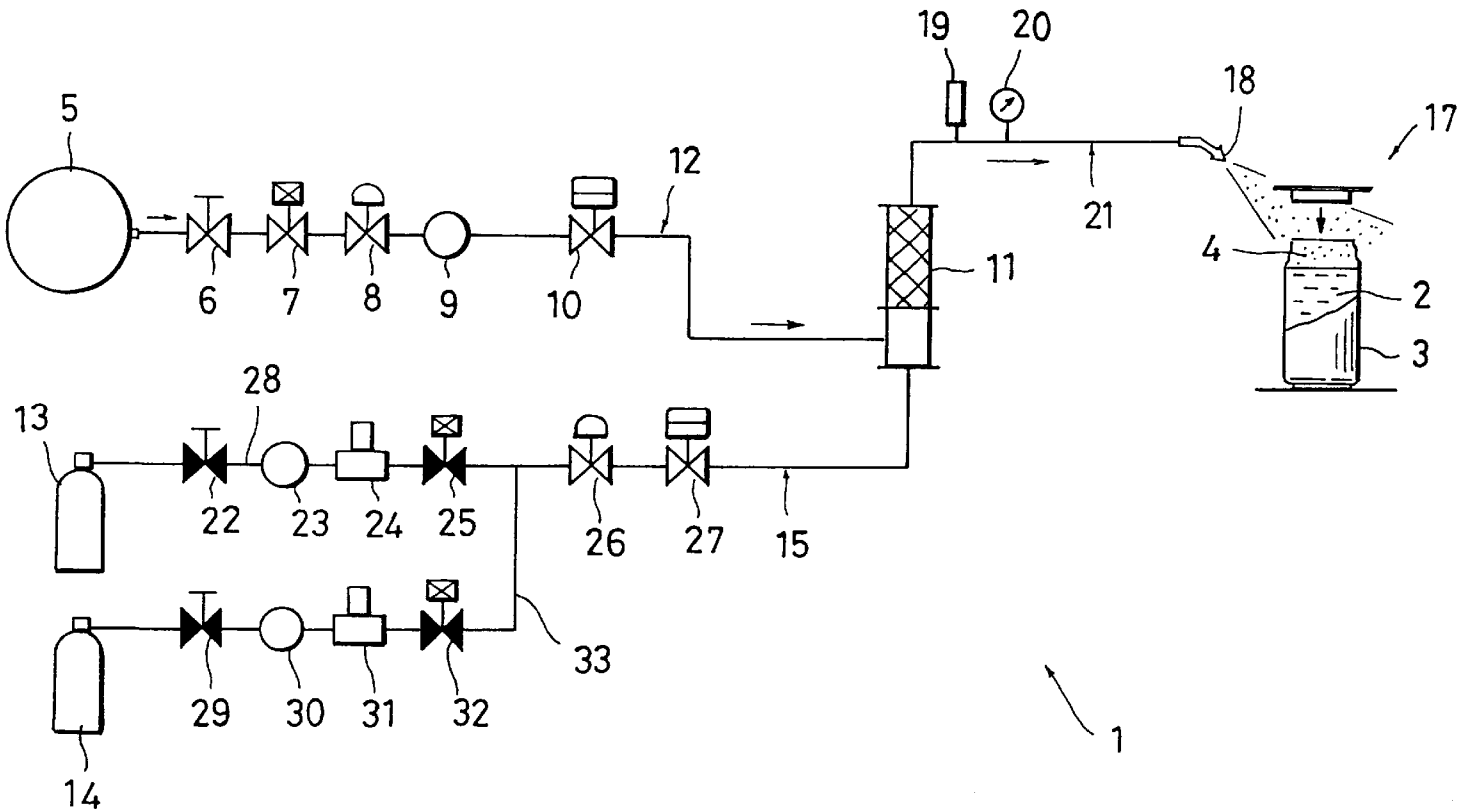
FIG. 6 is an explanatory view of supplying steam only showing the first embodiment of the present invention.
Figure 7:
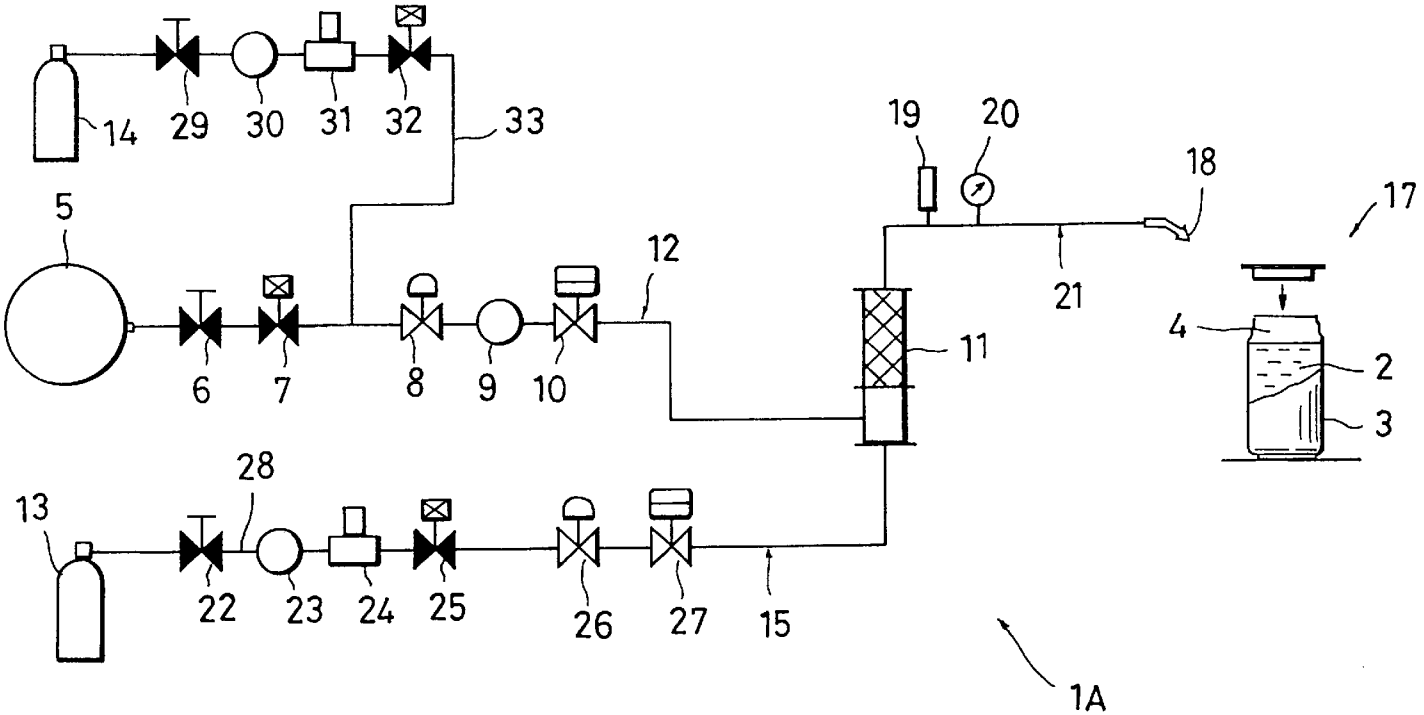
FIG. 7 is an explanatory view showing a second embodiment of the present invention.
Figure 8:
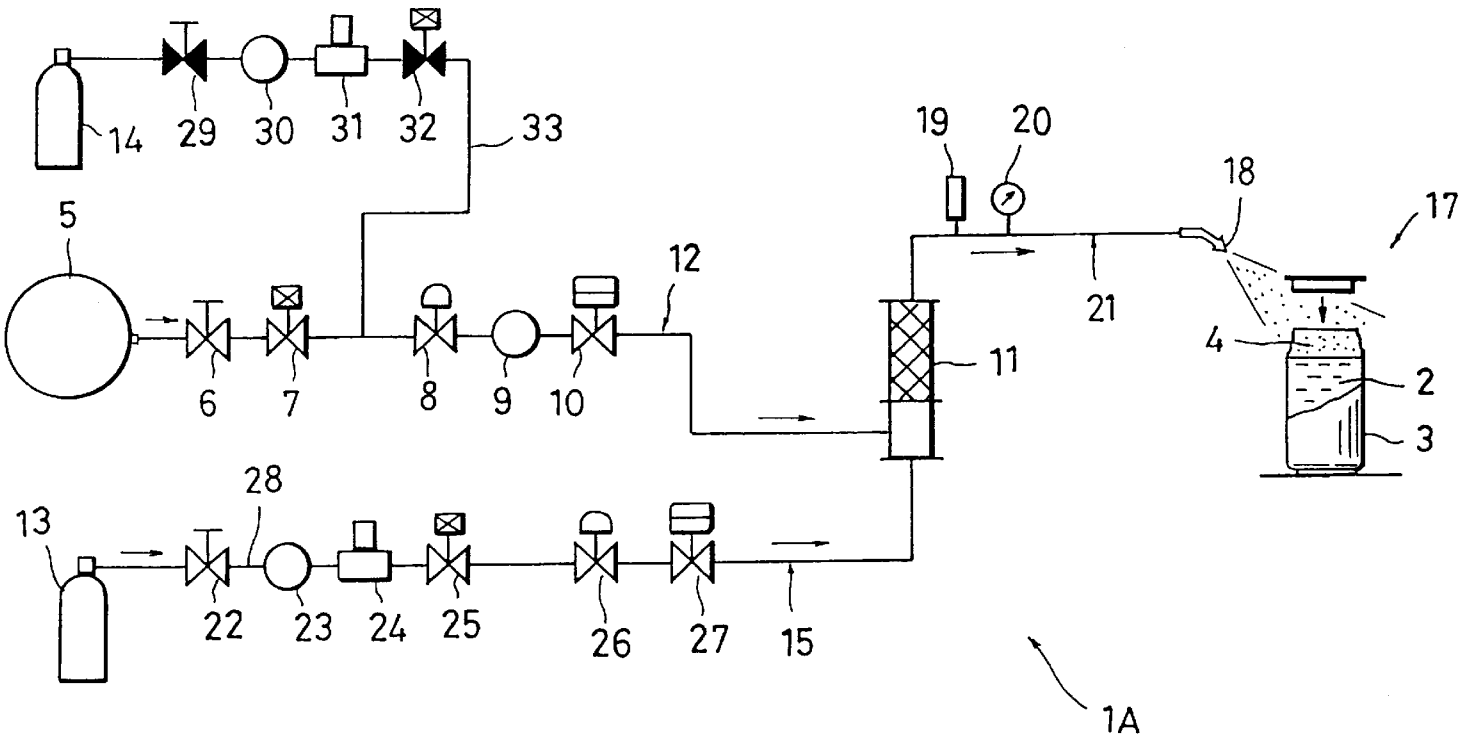
FIG. 8 is an explanatory view of supplying a mixture of steam and carbonic acid gas showing the second embodiment of the present invention.
Figure 9:
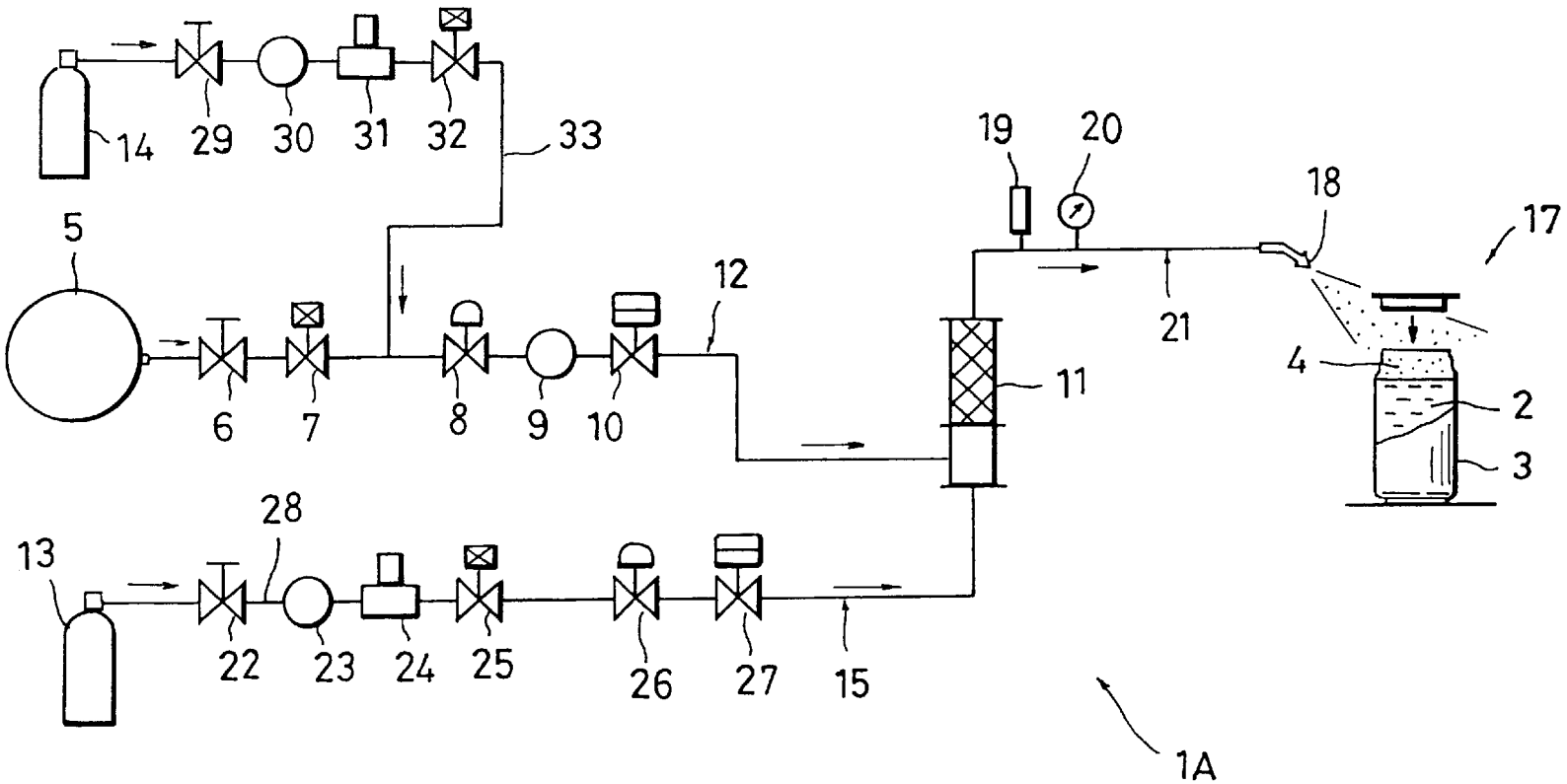
FIG. 9 is an explanatory view of supplying a mixture of steam and nitrogen gas showing the second embodiment of the present invention.
Figure 10:
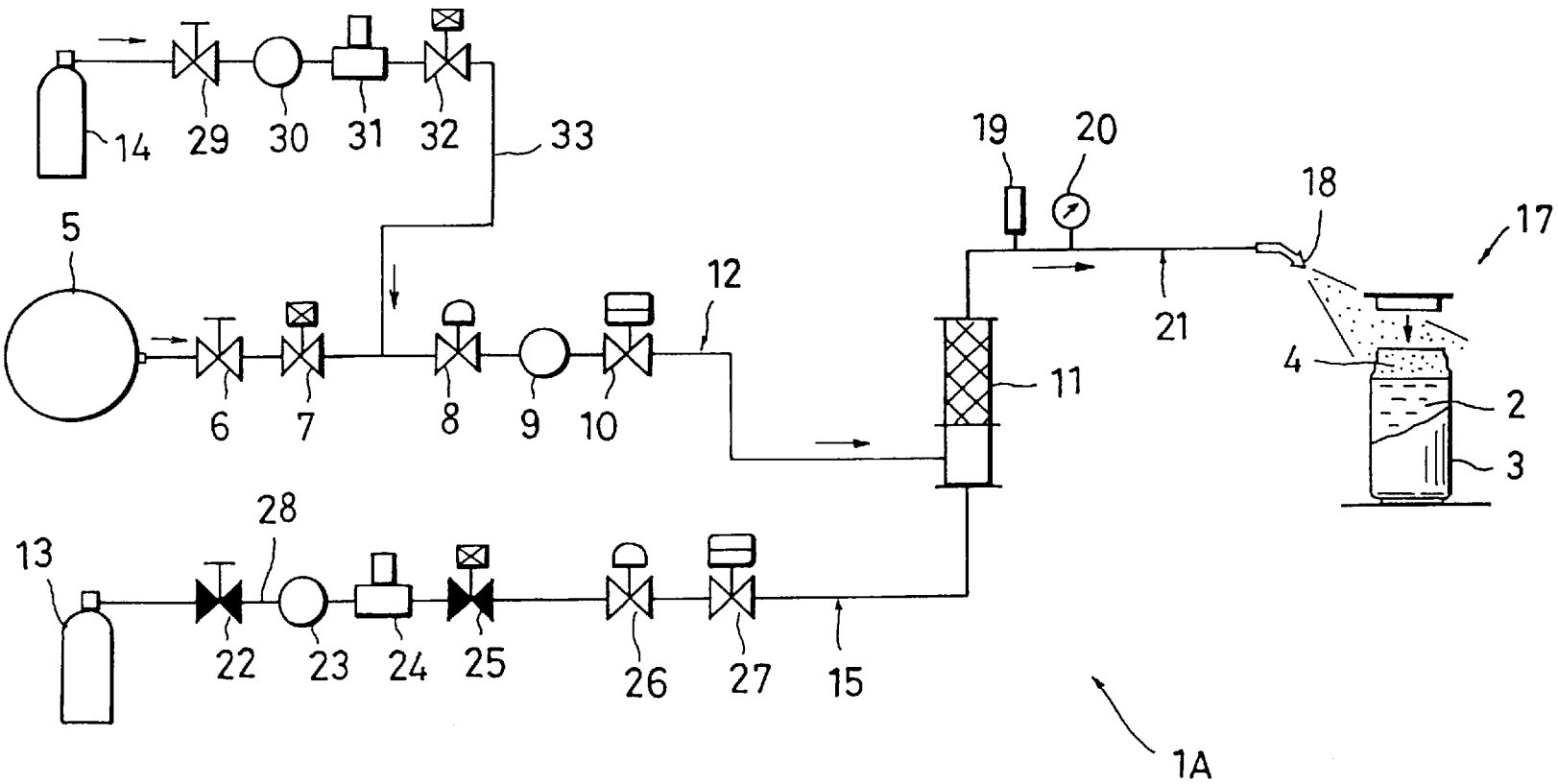
FIG. 10 is an explanatory view of supplying a mixture of carbonic acid gas and nitrogen gas.
Figure 11:
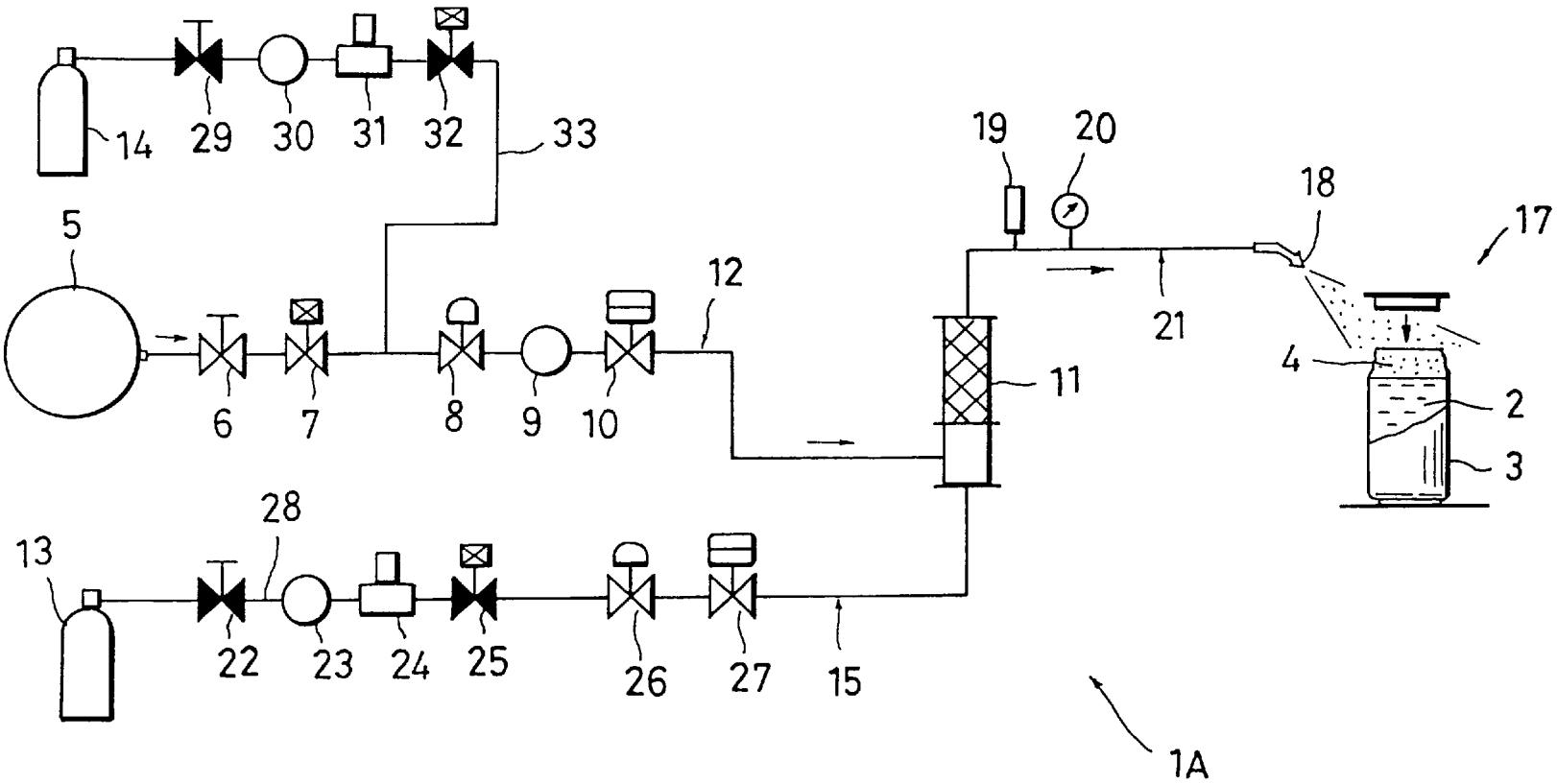
FIG. 11 is an explanatory view of supplying steam only showing the second embodiment of the present invention.

Moreover, when the steam is blown singly into the headspace 4 of the can 3 only, the steam is blown into the mixer 11 by opening the closure valve 6 and electromagnetic valve 7 of the steam supply path 12 as shown in FIG. 6. The steam gas defining an inert gas is blown out of the nozzle 18, and the steam gas has been blown into the headspace 4 of the can 3.

Other embodiments of the present invention will now be described referring to FIGS. 7 to 14.

A second embodiment of the present invention is shown in FIGS. 7 thru 11. It is distinguished from the first embodiment by the fact that the bottom end of the nitrogen gas supply path 33 is connected to a portion located between the electromagnetic valve 7 and the reducing valve 8 of the supply path 12. In an apparatus 1A for replacing air within the headspace 4 of the can 3 filled with the carbonated drink 2 formed in this way according to the second embodiment, the mixture of steam and carbonic acid gas, the mixture of nitrogen gas and steam, the mixture of carbonic acid gas and nitrogen gas or steam only can be blown selectively into the headspace 4 of the can 3 filled with the carbonated drink 2. Therefore, the apparatus can replace air within the headspace 4 of the can 3 filled with the carbonated drink 2.

Figure 12:
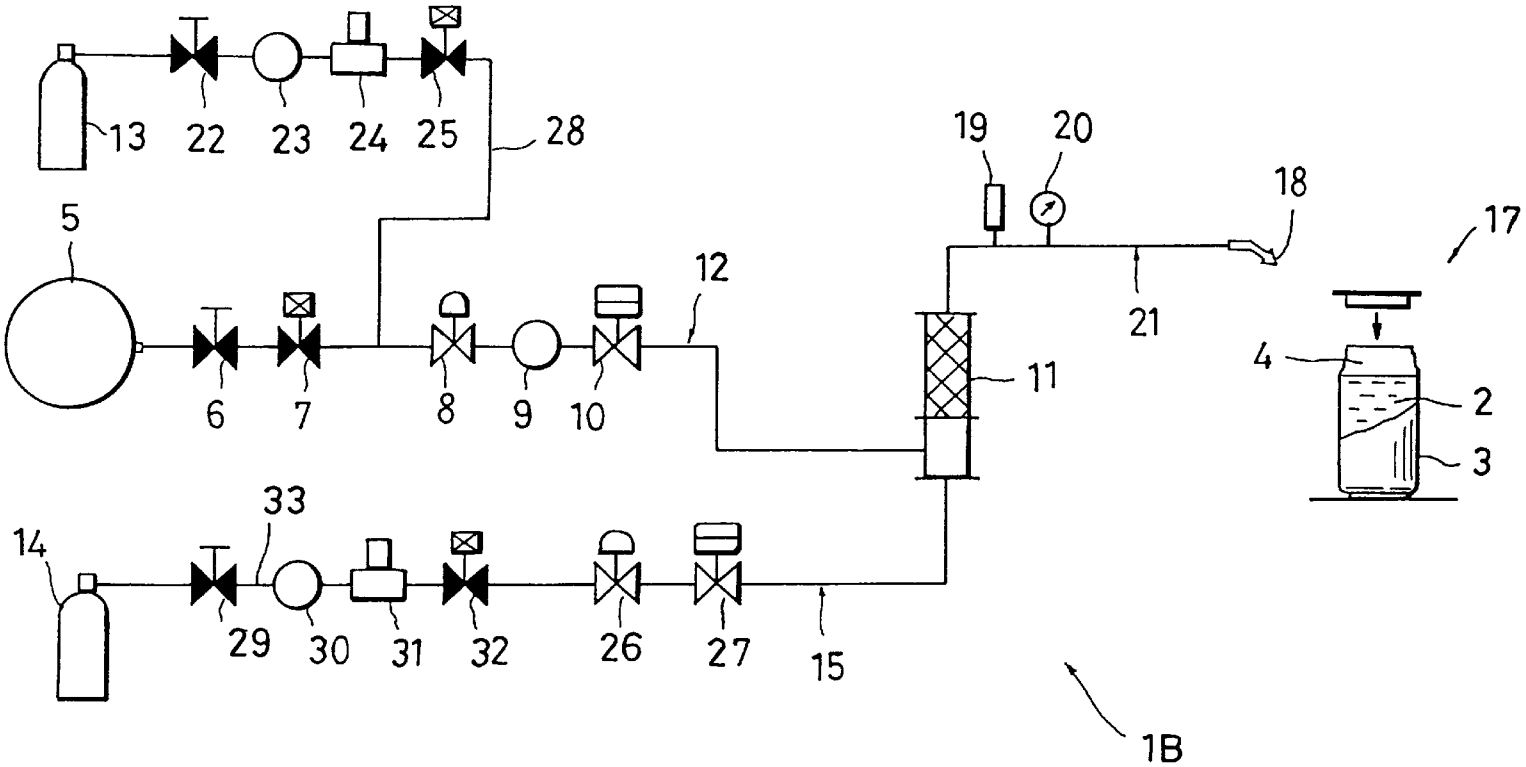
FIG. 12 is an explanatory view showing a third embodiment of the present invention.

A third embodiment of the present invention is shown in FIG. 12. It is distinguished from the second embodiment by the fact that the carbonic acid gas reservoir 13 is replaced with the nitrogen gas reservoir 14, and the nitrogen gas reservoir 14 is replaced with the carbonic acid gas reservoir 13. An apparatus 1B for replacing air within the headspace 4 of the can 3 filled with the carbonated drink 2 formed in this way according to the second embodiment will provide the same effects as the second embodiment.

Figure 13:
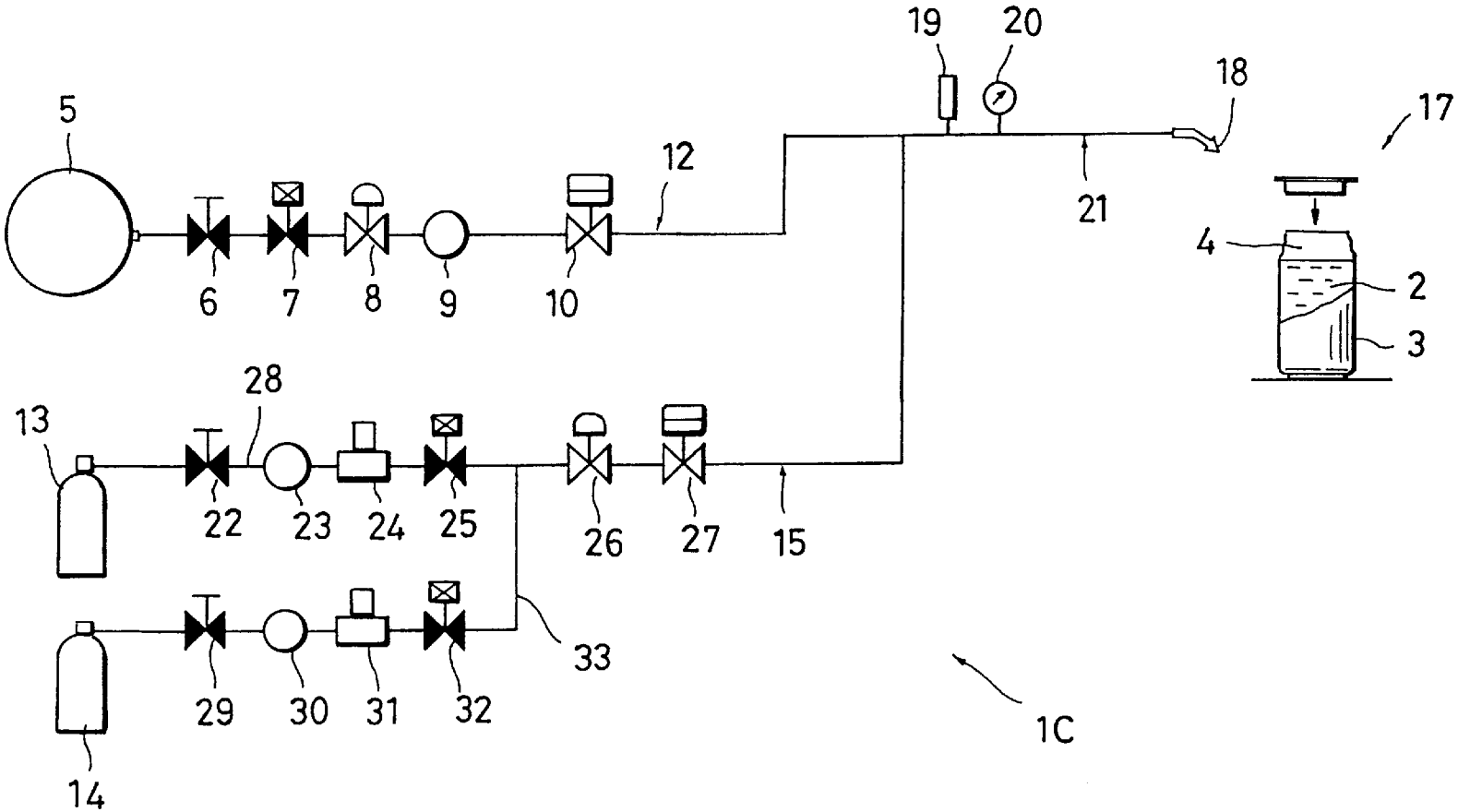
FIG. 13 is an explanatory view showing a fourth embodiment of the present invention.

A fourth embodiment of the present invention is shown in FIG. 13. It is distinguished from the first embodiment by the fact that the steam gas is supplied through the thermometer 19 and the pressure gauge 20 into the nozzle 18. In an apparatus 1C for replacing air within the headspace 4 of the can 3 filled with the carbonated drink 2 formed in this way according to the fourth embodiment, the air remaining within the headspace 4 of the can 3 can be replaced surely by steam.

Figure 14:
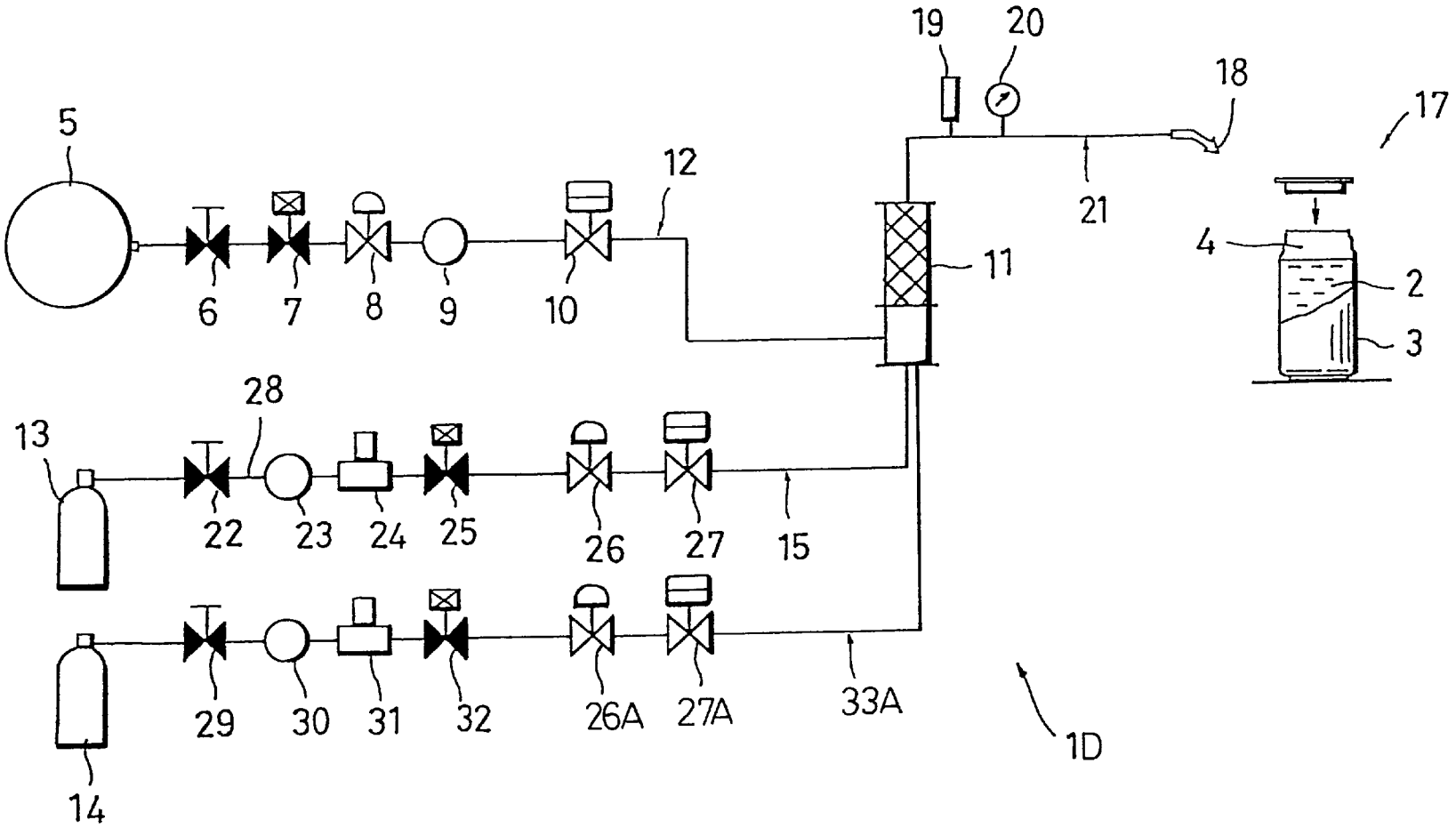
FIG. 14 is an explanatory view showing a fifth embodiment of the present invention.

A fifth embodiment of the present invention is shown in FIG. 14. It is distinguished from the first embodiment by the fact that the nitrogen gas supply path 33 is replaced from another nitrogen gas supply path 33A. The supply path 33A includes the closure valve 29, filter 30, mass-flowmeter 31, electromagnetic valve 32, reducing valve 26A and control valve 27A. The nitrogen gas provided from the nitrogen gas reservoir 14 is admitted through the supply path 33A to the mixer 11. In an apparatus 1D for replacing air within the headspace 4 of the can 3 filed with the carbonated drink 2 formed in this way according to the first embodiment, the air remaining within the headspace 4 of the can 3 can be replaced surely by steam, the mixture of steam and carbonic acid gas, the mixture of nitrogen gas and steam or the mixture of carbonic acid gas and nitrogen gas.

Moreover, concerning each of embodiments of the present invention, the apparatus can be used for a can filled with not only a carbonated drink but also juice drink, tea drink, coffee drink or the like.

The present invention as set forth above, has the advantages described below.

(1) An apparatus for replacing air within a headspace of a container comprises a boiler and a supply path of steam for introducing the steam to a nozzle through a steam regulator valve, a nozzle blowing gas into the headspace of the container filled with a liquid, located at a seaming device of a container filling apparatus, so that a mixture of steam and carbonic acid gas or a mixture of steam and nitrogen gas defining an inert gas is blown into the headspace 4 of the can 3 filled with a liquid. The air remaining within the headspace 4 of the can 3 filled with a liquid for drinking can be surely replaced by the inert gas.

Therefore, the quantity of the inert gas such as carbonic acid gas used can be reduced as compared with that of only carbonic acid gas in the prior art.

Moreover, it can prevent the working environment from becoming worse.

(2) As discussed above, the air remaining within the headspace of the can defining a container can be replaced surely by a mixture of steam and carbonic acid gas. Therefore, the quality of filled drink can be maintained as before.

(3) As discussed above, a mixture of steam and carbonic acid gas or nitrogen gas is blown into the headspace by the nozzle. Therefore, replacing operations can be done easily and efficiently.

An apparatus for replacing air within a headspace of a can filled with a carbonated drink includes a boiler; a supply path of steam admitting steam generated by the boiler through a control valve for steam-flow into a mixer; a supply path of gas admitting gases provided from either of a carbonic acid gas reservoir and a nitrogen gas reservoir through a control valve for gas-flow into the mixer; and a supply path of a mixture of gases admitting a mixture of gases supplied into the mixer into a nozzle which blows the mixture into the headspace of the can filled with the carbonated drink.

An apparatus for replacing air within a headspace of a can filled with a carbonated drink includes a boiler; a supply path of steam admitting steam generated by the boiler through a control valve for steam-flow into a mixer; a supply path of gas admitting gases provided from either of a carbonic acid gas reservoir and a nitrogen gas reservoir to the steam supply path as occasion demands; a second supply path of gas admitting gases provided from either of a carbonic acid gas reservoir or a nitrogen gas reservoir through a control valve for gas-flow into a mixer; and a supply path of a mixture of gases admitting a mixture of gases supplied into the mixer into a nozzle which blows the mixture into the headspace of the can filled with the carbonated drink. Optionally, the nozzle is located at a seaming device of a container filling apparatus.

What is claimed is:

1. An apparatus for replacing gas within a headspace of a container containing a beverage with a headspace gas, the apparatus comprising:

a steam supply and at least two inert gas supplies;

at least one nozzle at which the headspace is positionable;

a headspace gas supply path communicative with said nozzle;

independent gas supply paths each including an inlet connectable with a respective one of said steam supply and said at least two inert gas supplies and an outlet communicative with said headspace gas supply path; and at least one flow regulator disposed upstream of a respective outlet of each of said independent gas supply paths.

2. An apparatus according to claim 1, wherein said two inert gas supplies include a carbonic acid gas supply and a nitrogen gas supply.

3. An apparatus according to claim 1, further comprising:

a mixer connectably disposed between said independent gas supply paths and said headspace gas supply path for mixing at least two gases supplied from said steam supply and said at least two inert gas supplies upstream of said headspace gas supply path.

4. An apparatus according to claim 1, further comprising at least one of a thermometer and a pressure gauge disposed along said headspace gas supply path.

5. An apparatus according to claim 1, wherein said at least one nozzle includes a plurality of nozzles.

6. An apparatus according to claim 1, wherein said at least one flow regulator includes at least one of a closure valve, an electromagnetic valve, a reducing valve and a control valve.

7. An apparatus according to claim 1, further comprising a flowmeter disposed in at least one of said independent gas supply paths for said at least two inert gas supplies.

8. An apparatus according to claim 1, wherein at least one of said independent gas supply paths joins another of said independent gas supply paths upstream of said outlet of said another of said independent gas supply paths.

* * * * *